US007448447B2

(12) United States Patent
Walford

(10) Patent No.: US 7,448,447 B2
(45) Date of Patent: Nov. 11, 2008

(54) REAL-TIME PRODUCTION-SIDE MONITORING AND CONTROL FOR HEAT ASSISTED FLUID RECOVERY APPLICATIONS

(75) Inventor: Merrick Walford, Lons (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 157 days.

(21) Appl. No.: 11/307,889

(22) Filed: Feb. 27, 2006

(65) Prior Publication Data

US 2007/0199696 A1 Aug. 30, 2007

(51) Int. Cl.
*E21B 43/24* (2006.01)

(52) U.S. Cl. ..... 166/250.01; 166/303; 166/272.3; 166/272.7; 166/105

(58) Field of Classification Search ..... 166/250.01, 166/303, 66, 50, 268, 272.1, 272.3, 272.7, 166/269, 305.1, 68, 105
See application file for complete search history.

(56) References Cited

U.S. PATENT DOCUMENTS

| | | | | |
|---|---|---|---|---|
| 2,778,313 | A * | 1/1957 | Hill | 417/32 |
| 4,127,169 | A * | 11/1978 | Tubin et al. | 166/250.01 |
| 5,163,321 | A | 11/1992 | Perales | |
| 5,332,035 | A | 7/1994 | Schultz | |
| 6,877,555 | B2 * | 4/2005 | Karanikas et al. | 166/245 |
| 7,040,390 | B2 | 5/2006 | Tubel et al. | |
| 2002/0084074 | A1 * | 7/2002 | de Rouffignac et al. | 166/303 |

FOREIGN PATENT DOCUMENTS

| | | |
|---|---|---|
| RU | 2098615 | 12/1997 |
| RU | 2104393 | 2/1998 |
| RU | 2156860 | 9/2000 |
| RU | 2225942 | 3/2004 |
| RU | 2254461 | 6/2005 |
| RU | 2267604 | 1/2006 |
| RU | 2268356 | 1/2006 |
| SU | 1830411 | 7/1993 |

* cited by examiner

*Primary Examiner*—Kenneth Thompson
(74) *Attorney, Agent, or Firm*—Diana Sangalli; Daryl R. Wright; Bryan P. Galloway

(57) ABSTRACT

An automatic control system that protects downhole equipment and surface equipment from high temperatures resulting from the breakthrough of injection vapor. The system operates to derive an estimate of the temperature of production fluid at a location upstream from the downhole equipment. An alarm signal is generated in the event that this temperature exceeds a threshold temperature characteristic of injection vapor breakthrough. Electric power to the downhole equipment is automatically shut off in response to receiving the alarm signal. A bypass valve selectively directs production fluid to a bypass path. The system operates to derive an estimate of the temperature of the production fluid at a location upstream from the surface equipment. An alarm signal is generated when this temperature exceeds a threshold temperature characteristic of injection vapor breakthrough. The bypass valve is automatically controlled to direct production fluid to the bypass path in response to receiving the alarm signal.

49 Claims, 3 Drawing Sheets

REAL-TIME PRODUCTION-SIDE MONITORING AND CONTROL FOR HEAT ASSISTED FLUID RECOVERY APPLICATIONS

BACKGROUND OF THE INVENTION

1. Field of the Invention

This invention relates broadly to apparatus and processes for recovering fluid by injection of hot vapor or other heat assisted production techniques. More particularly, this invention relates to apparatus and processes for recovering natural bitumen and other forms of heavy oil by heat assisted production techniques.

2. Description of Related Art

There are many petroleum-bearing formations from which oil cannot be recovered by conventional means because the oil is so viscous that it will not flow from the formation to a conventional oil well. Examples of such formations are the bitumen deposits in Canada and in the United States and the heavy oil deposits in Canada, the United States, and Venezuela. In these deposits, the oil is so viscous, under the prevailing temperatures and pressures within the formations, that it flows very slowly (or not at all) in response to the force of gravity. Heavy oil is an asphaltic, dense (low API gravity), and viscous oil that is chemically characterized by its contents of asphaltenes (very large molecules incorporating most of the sulfur and perhaps 90 percent of the metals in the oil). Most heavy oil is found at the margins of geological basins and is thought to be the residue of formerly light oil that has lost its light-molecular-weight components through degradation by bacteria, water-washing, and evaporation. Natural bitumen (often called tar sands or oil sands) shares the attributes of heavy oil but is yet more dense and more viscous.

Heavy oil is typically recovered by injecting super-heated steam into the reservoir, which reduces the oil viscosity and increases the reservoir pressure through displacement and partial distillation of the oil. Steam may be injected continuously utilizing separate injection and production wells. Alternatively, the steam may be injected in cycles so that a well is used alternatively for injection and production (the so called "huff and puff" process).

Natural bitumen is so viscous that it is immobile in the reservoir. For oil sand deposits less than 70 meters deep, bitumen is recovered by mining the sands, then separating the bitumen from the reservoir rock by hot water processing, and finally upgrading the natural bitumen to synthetic crude oil. In deeper bitumen deposits, steam is injected into the reservoir in order to mobilize the oil for recovery. The product may be upgraded onsite or mixed with dilutent and transported to an upgrading facility.

FIGS. 1A and 1B illustrate a system for recovery of oil from a reservoir of natural bitumen. This system, which is commonly referred to as a steam-assisted gravity drainage system, employs a stacked pair of horizontal wells disposed in a reservoir 2 of natural bitumen which is typically sandwiched between a top layer of caprock 4 and a bottom layer of shale 6. The upper well 8, referred to as the injection well, is used to inject a hot vaporized fluid (such as steam and/or a solvent vapor) into the bitumen reservoir 2. The hot vaporized fluid heats the formation and mobilizes the bitumen. Gravity causes the mobilized bitumen to move toward the lower well 10, referred to as the production well, as shown in FIG. 1B. The bitumen fluid is then pumped by an artificial lift system to the surface through the production well 10.

Recent advances in electrical submersible pump (ESP) designs (such as the HOTLINE ESP commercially available from Schlumberger) are capable of operation in the expected temperature ranges (e.g., greater than 205° C.) of many heat assisted production techniques including the steam-assisted drainage system of FIGS. 1A and 1B for bitumen recovery. However, the downhole ESP can be damaged (or its operational lifetime adversely impacted) by the periodic direct breakthrough of injection vapor, which is referred to herein as "injection vapor breakthrough." The injection vapor is commonly supplied to the injection well 8 at a temperature on the order of 260° C. When injection vapor breakthrough occurs, injection vapor enters the production well without experiencing significant cooling relative to its hot temperature as supplied to the injection well. The high temperature of the injection vapor breakthrough can damage the downhole ESP when it is running and/or can adversely impact its operational life.

Similar problems can be experienced by surface equipment, such as a multiphase flow meter. The multiphase flow meter continually measures the individual phases of the production fluid without the need for prior separation, which allows for quick and efficient well performance trend analysis and immediate well diagnostics. Such multiphase flow meters can be damaged, or their operational life shortened significantly, by the high temperatures that result from injection vapor breakthrough.

Thus, there remains a need in the art to provide mechanisms that protect downhole equipment and surface equipment from the high temperatures that result from the breakthrough of injection vapor in heat assisted production applications.

BRIEF SUMMARY OF THE INVENTION

It is therefore an object of the invention to provide a mechanism that protects downhole equipment from the high temperatures that result from the breakthrough of injection vapor in heat assisted production applications.

It is another object of the invention to provide a mechanism that protects surface equipment from the high temperatures that result from the breakthrough of injection vapor in heat assisted production applications.

In accord with these objects, which will be discussed in detail below, an automatic control system is provided that protects downhole equipment (such as ESPs) as well as surface equipment (such as multiphase flowmeters) from the high temperatures that result from the breakthrough of injection vapor. With respect to downhole equipment protection, the system operates to derive an estimate of the temperature of the production fluid at a location upstream from the downhole equipment. A first alarm signal is generated in the event that this temperature exceeds a threshold temperature characteristic of injection vapor breakthrough. Supply of electric power to the downhole equipment is automatically shut off in response to receiving the first alarm signal. With respect to surface equipment, a bypass path is provided together with a bypass valve for selectively directing production fluid to the bypass path. The system operates to derive an estimate of the temperature of the production fluid at a surface location upstream from the surface equipment. A second alarm signal is generated in the event that this temperature exceeds a threshold temperature characteristic of injection vapor breakthrough. The bypass valve is automatically controlled to direct production fluid to the bypass path in response to receiving the second alarm signal.

It will be appreciated that by automatically turning off the downhole equipment while injection vapor breakthrough passes by the downhole equipment, damage to the downhole equipment can be avoided and its operational life increased.

Similarly, by directing the injection vapor breakthrough along a bypass path, damage to the surface equipment can be avoided and its operational life increased.

According to one embodiment of the invention, the temperature measurements of the system are derived by optical time-domain reflectometry of optical pulses that propagate along an optical fiber that extends to appropriate measurement locations along the production tubing.

Additional objects and advantages of the invention will become apparent to those skilled in the art upon reference to the detailed description taken in conjunction with the drawings.

DETAILED DESCRIPTION OF THE INVENTION

In the description, the terms "downstream" and "upstream"; "downhole" and "uphole"; "down" and "up"; "upward" and "downward"; and other like terms indicate relative positions in a wellbore relative to the direction of fluid flow therein. In other words, fluid flows from "upstream" locations and elements to "downstream" locations and elements. Note that when applied to apparatus and methods for use in wellbores that are deviated or horizontal, such terms may refer to a left to right relationship, right to left relationship, or other relationships as appropriate.

Figure 2A:
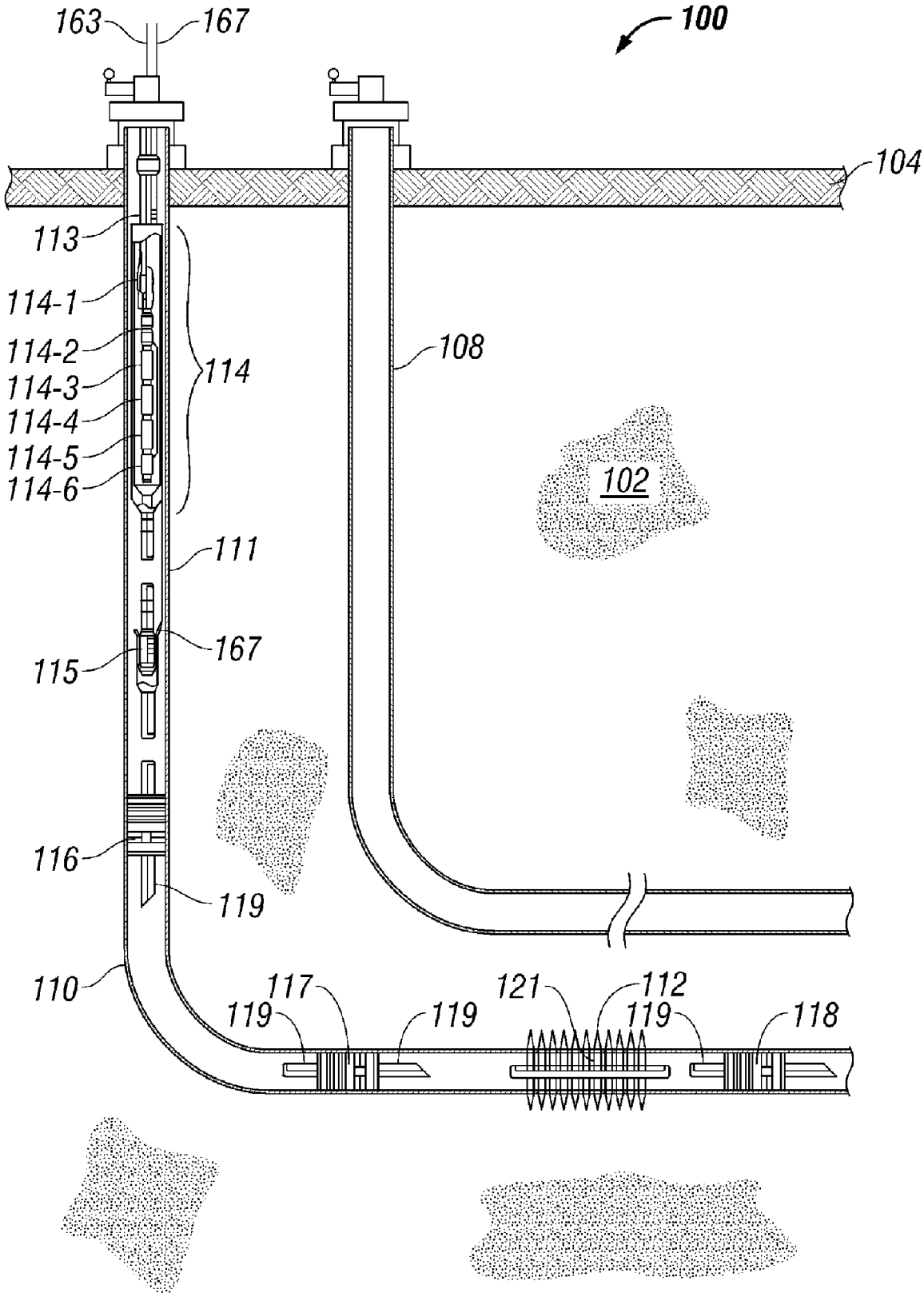
FIG. 2A is a pictorial illustration of the downhole components of an improved steam-assisted gravity drainage system in accordance with the present invention.
Figure 2B:
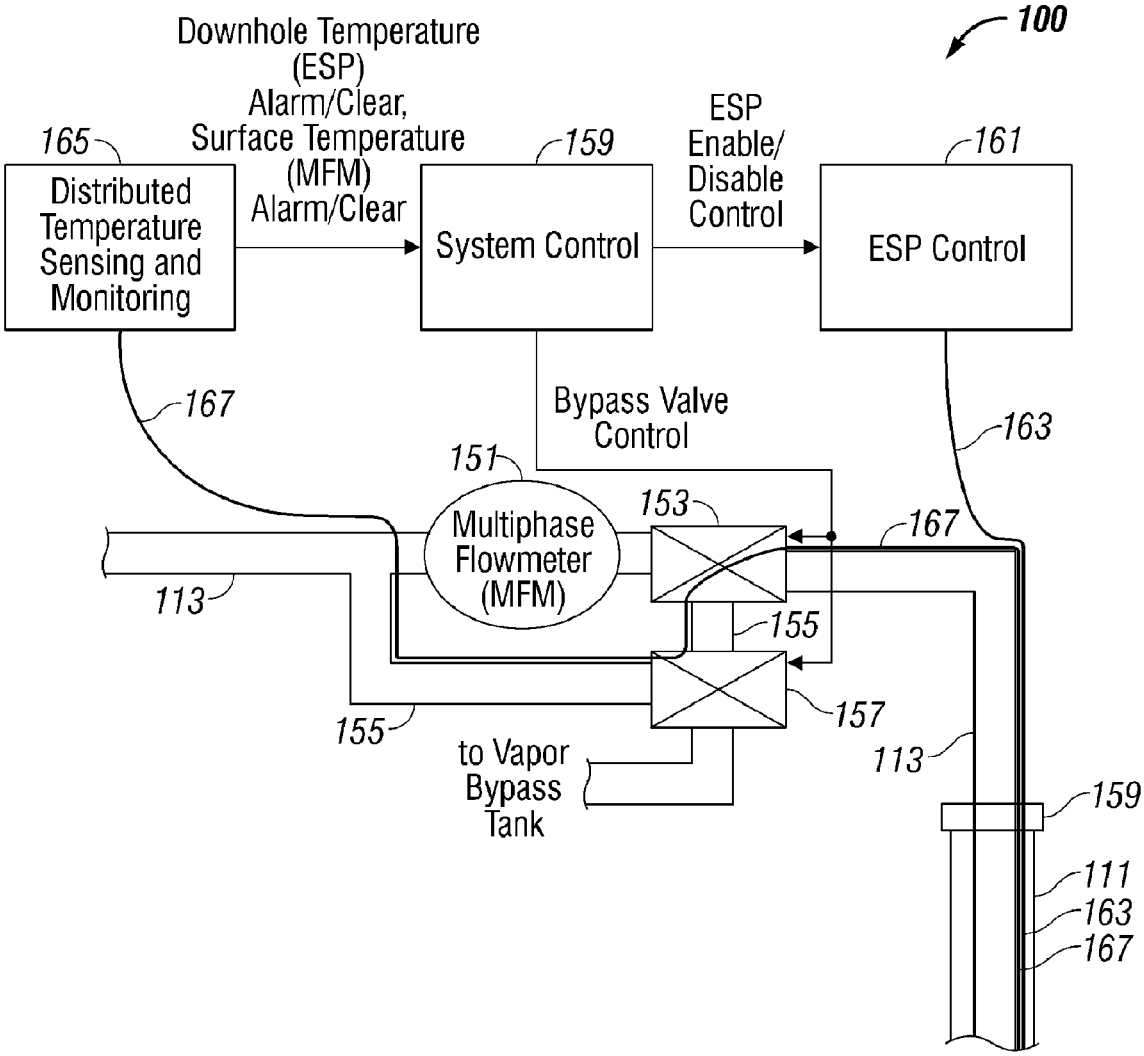
FIG. 2B is a functional block diagram of the surface components of the improved steam-assisted gravity drainage system in accordance with the present invention.

Turning now to FIGS. 2A and 2B, there is shown an improved steam-assisted gravity drainage system 100 in accordance with the present invention. The system incorporates an automatic control system that protects downhole equipment and surface equipment from the high temperatures that result from the breakthrough of injection vapor.

Figure 1A:
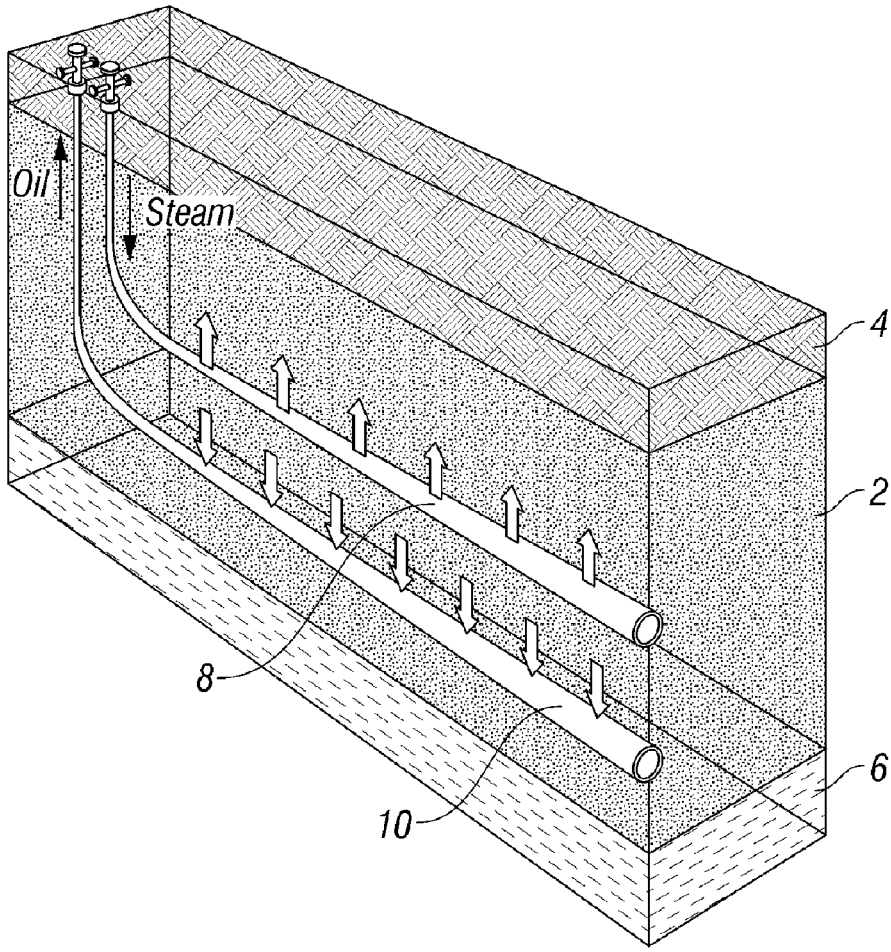
FIGS. 1A and 1B are pictorial illustrations of a steam-assisted gravity drainage system.
Figure 1B:
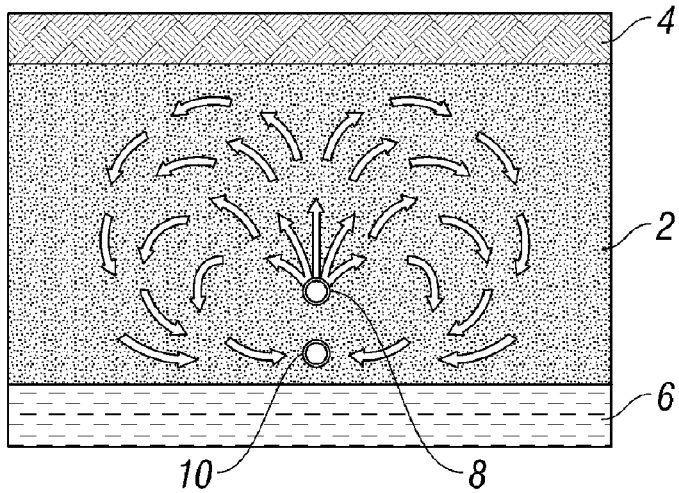

As is conventional, the system 100 employs a stacked pair of horizontal wells disposed in a reservoir 102 of natural bitumen, which is typically sandwiched between a top layer of caprock 104 and a bottom layer of shale (not shown). An injection well 108 injects a hot vaporized fluid, such as steam, carbon dioxide, and/or a solvent, into the bitumen reservoir 102 as is well known in the art. The injection of the hot vaporized fluid heats the reservoir 102 and mobilizes the bitumen. Gravity causes the mobilized bitumen to move toward the production well 110 as shown in FIG. 1B.

The production well 110 employs a casing 111 that is cemented in place. The casing 111 has a plurality of perforations 112 which allow fluid communication between the interior of the casing 111 and the bitumen reservoir 102. Production tubing 113 extends within the casing 111 from the surface to an ESP assembly 114 disposed within the casing 111. A stinger assembly 115 extends within the casing 111 between the downhole end of the ESP assembly 114 and a production packer 116 (if used). An isolation packer 117 and a sump packer 118 may or may not be used to isolate the production zone within the lateral section of the casing 111. A tubing string 119 (sometimes referred to as coiled tubing, workstring, or other terms well known in the art) extends from the production packer 116 (if used) to the sump packer 118 (if used). A portion of the tubing string 119 in the vicinity of the perforations 112 includes a screen member 121 as is well known in the art. Generally, the screen member 121 has a perforated base pipe with filter media disposed thereon to provide the necessary filtering. Such filter media can be realized, for example, from wire wrapping, mesh material, prepacks, multiple layers, woven mesh, sintered mesh, foil material, wrap-around slotted sheet, or wrap-around perforated sheet. Many common screen members include a spacer that offsets the filter media from the base pipe in order to provide a flow annulus therebetween. Typically, granular filtercake material, such as a gravel pack or resin-based pack, is injected into the wellbore such that it fills the annular space between the screen member 121 and the well casing 111 and perforations 112 therethough.

The ESP assembly 114 is powered by electrical energy delivered thereto from the surface. The ESP assembly 114 pumps mobilized bitumen fluid that flows into the perforations 112 and screen member 121 through the tubing string 119 and stinger assembly 115 and up the production tubing 113 to the surface. The ESP assembly 114 may comprise a variety of components depending on the particular application or environment in which it is used. The exemplary ESP assembly 114 shown in FIG. 2A includes a handling sub 114-1, a discharge head 114-2, a pump section 114-3, a protector/seal section 114-4, a motor section 114-5, and a motor plug 114-6. The handling sub 114-1 is used to handle the ESP assembly 114 during installation and acts as a connector to the production tubing thread that leads to the top of the production tubing 113. The pump section 114-3 provides mechanical elements (e.g., vanes, pistons) that pump mobilized bitumen fluid from intake ports and out the discharge head 114-2 for supply to the surface. The intake ports provide a fluid path for drawing fluid into the pump section 114-3 from the reservoir 102 via the stinger 115, the tubing string 119, the screen member 121 and the perforations 112. The protector/seal section 114-4 transmits torque generated by the motor section 114-5 to the pump section 114-3 for driving the pump. The protector/seal section 114-4 also provides a seal against fluids/contaminants entering the motor section 114-5. The motor section 114-5 provides an electric motor assembly that is driven by electric power supplied thereto from the surface. The motor plug 114-6, which is disposed on the bottom end of the ESP assembly 114, provides an additional clamping position as well as protecting the ESP assembly when running the completion. A downhole monitoring tool (not shown) is typically provided between the motor section 114-5 and the motor plug 114-6. The downhole monitoring tool provides for monitoring/telemetry of downhole conditions/parameters at or near the pumping location.

As shown in FIG. 2B, at the surface the production tubing 113 extends beyond the casing 111. A multiphase flowmeter 151 is provided in the production tubing path. The multiphase flow meter 151 continually measures the individual phases of the production fluid flowing through the production tubing 113 without the need for prior separation, which allows for quick and efficient well performance trend analysis and immediate well diagnostics. A bypass path around the multiphase flowmeter 151 is provided by a diverter valve 153 and diverter tubing section 155. A second diverter valve 157 may be used to divert vapor fluid and possibly other production fluids that flow through the bypass path to a vapor bypass tank or other suitable processing means. The diverter valve 153 and the diverter valve 157 are electronically actuated (e.g., open and closed) and controlled by a system control module 159.

An ESP control module 161 is provided that controls the operation of the ESP motor section 114-5 (FIG. 2A) of the ESP assembly 114 via power cables 163 therebetween. The power cables 163 (which are typically armored-protected, insulated conductors) extend through the wellhead outlet 159 and downward along the exterior of the production tubing 113 in the annular space between the production tubing 113 and the casing 111. When it is present, telemetry signals generated by the downhole monitoring tool of the ESP assembly 114 are communicated over the power cables 163. The ESP control module 161 is capable of selectively turning on and shutting off the supply of power to the ESP motor section 114-5 supplied thereto via the power cables 163. The ESP control module 161 also may incorporate variable-speed drive functionality that adjusts pump output by varying the operational motor speed of the ESP motor section 114-5. In steam-assisted gravity drainage system wells the temperatures are generally too high to use conventional pressure and temperature sensors to shutdown the ESP. Consequently, slugs of hot fluid are presently allowed to pass through the pumps, with the attendant detrimental effects. In contrast, the present invention's use of a fiber optic distributed temperature sensing (DTS) system to detect a hot slug of fluid allows the pump to be shutdown before the slug of hot fluid reaches it.

Therefore, production well 110 employs a fiber optic distributed temperature sensing and monitoring system realized by a surface-located fiber optic temperature sensing and monitoring module 165 with an optical fiber 167 extending therefrom. In the illustrative embodiment, the optical fiber 167 is deployed as a control line that extends along the bypass path, then along the production tubing 113 and down through the wellhead outlet 159 to the stinger assembly below the ESP assembly 114. Similar to the power cables 163, the fiber optic control line 167 extends downward along the exterior of the production tubing 113 in the annular space between the production tubing 113 and the casing 111. The fiber optic control line 167 may terminate at a predetermined position downstream of the ESP assembly 114 (e.g., adjacent the stinger assembly 111) as shown. The depth at which the fiber optic control line 167 may be terminated will be determined so as to detect a hot slug of fluid sufficiently early to shutdown the ESP and allow the motor to cool before the hot slug passes. Alternatively, the fiber optic control line 167 may continue further into the wellbore of the production well 110, for example to the vicinity of the production zone. In yet other embodiments, the fiber optic control line may form a loop that returns back up the production well 110 for double-ended sensing as is well known, or the loop may continue to the injection well 108 or other wells (not shown) for distributed temperature sensing therein. In still other embodiments, the distributed temperature sensing and monitoring module 165 may be located adjacent the injection well 108 or adjacent another well and the temperature alarm/clear signals communicated therefrom.

The temperature sensing operation of the fiber optic distributed temperature sensing and monitoring module 165 is based on optical time-domain reflectometry (OTDR), which is commonly referred to as "backscatter." In this technique, a pulsed-mode high power laser source launches a pulse of light along the optical fiber 167 through a directional coupler. The optical fiber 167 forms the temperature sensing element of the system and is deployed where the temperature is to be measured. As the pulse propagates along the optical fiber 167, its light is scattered through several mechanisms, including density and composition fluctuations (Rayleigh scattering) as well as molecular and bulk vibrations (Raman and Brillouin scattering, respectively). Some of this scattered light is retained within the fiber core and is guided back towards the source. This returning signal is split off by the directional coupler and sent to a highly sensitive receiver. In a uniform fiber, the intensity of the returned light shows an exponential decay with time (and reveals the distance the light traveled down the fiber based on the speed of light in the fiber). Variations in such factors as composition and temperature along the length of the fiber show up in deviations from the "perfect" exponential decay of intensity with distance. The OTDR technique is well established and used extensively in the optical telecommunications industry for qualification of a fiber link or fault location. In such an application, the Rayleigh backscatter signature is examined. The Rayleigh backscatter signature is unshifted from the launch wavelength. This signature provides information on loss, breaks, and inhomogeneities along the length of the fiber; and it is very weakly sensitive to temperature differences along the fiber. The two other backscatter components (the Brillouin backscatter signature and the Raman backscatter signature) are shifted from the launch wavelength and the intensity of these signals are much lower than the Rayleigh component. The Brillouin backscatter signature and the "Anti-Stokes" Raman backscatter signature are temperature sensitive. Either one (or both) of these backscatter signatures can be extracted from the returning signals by optical filtering and detected by a detector. The detected signals are processed by the signal processing circuitry, which typically amplifies the detected signals and then converts (e.g., digitizes by a high speed analog-to-digital converter) the resultant signals into digital form. The digital signals may then be analyzed to generate a temperature profile along the optical fiber 167. The optical fiber 167 can be either multimode fiber or single mode fiber. An example of a commercially available optical fiber distributed temperature sensing system is the SENSA DTS System, sold by Schlumberger.

The fiber optic distributed temperature sensing and monitoring module 165 is controlled to monitor the downhole temperature at a location below the ESP assembly 114 and raise an alarm if the temperature at this location exceeds a predetermined maximum temperature. The predetermined maximum temperature is set to a temperature that differentiates between the flow of normal production fluid and the flow of injection vapor breakthrough. In this manner, the alarm is indicative of injection vapor breakthrough (typically referred to as a "hot slug") flowing through the production tubing at the location below the ESP assembly. The alarm is cleared when the measured temperature drops to a temperature that is indicative that the flow of normal production fluid has returned (i.e., the injection vapor breakthrough flow has passed). The downhole temperature alarm and clear signals are communicated from the fiber optic distributed temperature sensing and monitoring module 165 to the system control module 159. In response to receipt of the downhole temperature alarm signal, the system control module 159 sends an ESP Disable command to the ESP control module 161, which operates to turn off power to the ESP motor 114-5. In response to receipt of the alarm clear signal, the system control module 159 sends an ESP Enable command to the ESP control module 161, which operates to control the power supplied to the ESP motor 114-5 in accordance with a designated control scheme. Typically, such control schemes monitor the downhole pressure and control the power supplied to the ESP motor 114-5 in the event that pressure anomalies are detected. Variable speed controls can be used to adjust the power supplied to the ESP motor 114-5 in order to maximize production based on the real-time downhole pressure measurements. It is commonplace for the control scheme of the ESP motor 114-5 to be dynamically updated for optimal performance. In this manner, the distributed temperature sensing and monitoring module 165, the system control module 159, and the ESP control module 161 cooperate to turn off power to the ESP motor 114-5 while injection vapor breakthrough flows through the tubing string and past the ESP assembly 114. This reduces the risk of damage on the ESP motor 114-5 that is caused by the hot temperatures of the injection vapor breakthrough when the motor is running and is expected to improve the operational life of the ESP motor in such high heat conditions.

The mechanism by which the hot slug of fluid moves past the ESP when it is shutdown is explained as follows. Steam-assisted gravity drainage wells use a very low wellhead pressure in order to avoid flashing of the steam out of the produced fluid below the ESP. If the ESP is turned off, the hydrostatic column of fluid in the production tubing prevents the steam from migrating through the ESP and up the tubing. Instead it migrates up the annulus to the surface and is vented to a special tank. This vent is a common feature of steam-assisted gravity drainage wells for this purpose. The hot slug would be expected to cool quickly in the annulus, which is usually a large volume, and the steam will dissipate back into the fluid which will then fall back as it cools and will be suitable for pumping up through the production tubing once the ESP is restarted.

The fiber optic distributed temperature sensing and monitoring module 165 is also controlled to monitor temperature at a surface location upstream from the multiphase flowmeter 151 and raise an alarm if the temperature at this surface location exceeds a predetermined maximum temperature. Here too, the predetermined maximum temperature is set to a temperature that differentiates between the flow of normal production fluid and the flow of injection vapor breakthrough. In this manner, the alarm is indicative of vapor breakthrough (typically referred to as a "hot slug") flowing through the production tubing at the surface location upstream from the multiphase flowmeter. The alarm is cleared when the temperature drops to a temperature that is indicative that the flow of normal production fluid has returned (i.e., the injection vapor breakthrough flow has passed). These flowmeter temperature alarm and clear signals are communicated from the fiber optic temperature sensing and monitoring module 165 to the system control module 159. In response to receipt of the flowmeter temperature alarm signal, the system control module 159 controls the diverter or bypass valve 153 to direct the production fluid along the diverter tubing section or bypass path 155, thereby bypassing the multiphase flowmeter 151. Optionally, it can also control the diverter or bypass valve 157 to direct the production fluid flow along the bypass path to a tank or other suitable processing means. In this manner, the distributed temperature sensing and monitoring module 165 and the system control module 159 cooperate to direct vapor breakthrough though the bypass tubing 155 and avoid thermal contact with the multiphase flowmeter 151. This reduces the risk of damage to the multiphase flowmeter 151 and is expected to improve the operational life of the multiphase flowmeter 151 in such high heat conditions.

There have been described and illustrated herein an embodiment of an improved steam-assisted gravity drainage system. The system incorporates an automatic control system that protects downhole equipment (such as an ESP) as well as surface equipment (such as a multiphase flowmeter) from the high temperatures that result from the breakthrough of injection vapor. While particular embodiments of the invention have been described, it is not intended that the invention be limited thereto, as it is intended that the invention be as broad in scope as the art will allow and that the specification be read likewise. Thus, while a particular stacked horizontal well pair configuration has been disclosed, it will be appreciated that other well configurations (such as one or more vertical-type injector wells that work in conjunction with one or more production wells, multi-branch horizontal injector and/or production well configurations, or other suitable configurations) can be used as well. In addition, while particular types of completions have been disclosed, it will be understood that different completion types can be used. For example, and not by way of limitation, frac-pack completions, open-hole completions, stand-alone screen completions, and expandable screen completions can be used. Remotely controlled hydraulic-actuated packers can be employed in intelligent completion applications. Also, while fiber optic distributed sensing and monitoring methodologies are preferred, it will be recognized that other remote temperature sensing and monitoring technologies, such as point sensors, can be used. Additionally, fiber optic pressure sensors, or other types of pressure sensors, may be used in place of, or as a supplement to, temperature sensors in the present invention. Furthermore, while the automatic system is described as part of a steam-assisted gravity drainage application, it will be understood that it can be similarly used as part of other heat assisted production applications for bitumen and/or other heavy oils. Furthermore, it is contemplated that the present invention can be employed in other heat assisted fluid recovery applications, such as the heat assisted removal of contaminants from soil. It will therefore be appreciated by those skilled in the art that yet other modifications could be made to the invention without deviating from its scope as claimed.

What is claimed is:

1. An apparatus for use in a heat assisted fluid recovery application that injects hot vaporized fluid in the vicinity of a production well, the production well employing electrically powered downhole equipment to pump production fluid therefrom, the apparatus comprising:

temperature sensor and monitoring means for characterizing temperature of the production fluid at a location upstream from the downhole equipment of the production well;

alarm generation means for generating an alarm signal in the event that said temperature at the upstream location exceeds a threshold temperature characteristic of injection vapor breakthrough;

in response to receiving said alarm signal, control means, operably coupled to said alarm generation means and said downhole equipment, for shutting off supply of electric power to the downhole equipment prior to the downhole equipment reaching the threshold temperature characteristic of injection vapor breakthrough; and wherein the temperature sensor and monitoring means comprises an optical fiber that extends down the production well at least to said location upstream from the downhole equipment.

2. An apparatus according to claim 1, further comprising:

alarm clearing means for generating an alarm clear signal in the event that said temperature is characteristic that normal production fluid flow has resumed.

3. An apparatus according to claim 2, wherein:

said control means is operably coupled to said alarm clearing means and controls supply of electric power to the downhole equipment in accordance with a designated control scheme in response to receiving said alarm clear signal.

4. An apparatus according to claim 1, wherein:

said temperature sensor and monitoring means derives a temperature measurement at said location upstream from the downhole equipment by optical time-domain relectometry of optical pulses that propagate along said optical fiber.

5. An apparatus according to claim 1, wherein:

the downhole equipment comprises an electrical submersible pump that is fluidly coupled to a production string that extends to the surface.

6. An apparatus according to claim 1, wherein:

said production fluid comprises recovered heavy oil.

7. An apparatus according to claim 6, wherein:

said recovered heavy oil is extracted from bitumen.

8. An apparatus for use in a heat assisted fluid recovery application that injects hot vaporized fluid in the vicinity of a production well, the production well employing surface equipment that is thermally coupled to the production fluid pumped therefrom, the apparatus comprising:

a production fluid path for production fluid flow, the production fluid thermally coupled to the surface equipment when flowing in said production fluid path;

a bypass path for the production fluid around the surface equipment;

bypass valve means for selectively directing production fluid to said bypass path and away from said production fluid path;

temperature sensor and monitoring means for characterizing temperature of the production fluid at a surface location upstream from the surface equipment of the production well;

alarm generation means for generating an alarm signal in the event that said temperature at the upstream surface location exceeds a threshold temperature characteristic of injection vapor breakthrough; and in response to receiving said alarm signal, control means, operable coupled to said alarm generation means and said bypass valve means, for controlling said bypass valve means to direct production fluid to said bypass path and away from said production fluid path to avoid thermal coupling of the production fluid to the surface equipment through said production fluid path.

9. An apparatus according to claim 8, further comprising:

alarm clearing means for generating an alarm clear signal in the event that said temperature is characteristic that normal production fluid flow has resumed.

10. An apparatus according to claim 9, wherein:

said control means is operably coupled to said alarm clearing means and operates to deactivate said bypass valve means in response to receiving said alarm clear signal.

11. An apparatus according to claim 8, wherein:

the temperature sensor and monitoring means comprises an optical fiber that extends at least to said surface location upstream from the surface equipment.

12. An apparatus according to claim 11, wherein:

said temperature sensor and monitoring means derives a temperature measurement at said surface location upstream from the surface equipment by optical time-domain reflectometry of optical pulses that propagate along said optical fiber.

13. An apparatus according to claim 8, wherein:

the surface equipment comprises a multiphase flowmeter that analyzes production fluid flowing through a production string that extends down the production well.

14. An apparatus according to claim 8, wherein:

said production fluid comprises recovered heavy oil.

15. An apparatus according to claim 14, wherein:

said recovered heavy oil is extracted from bitumen.

16. A method for use in a heat assisted fluid recovery application that injects hot vaporized fluid in the vicinity of a production well, the production well employing electrically powered downhole equipment to pump production fluid therefrom, the method comprising:

observing temperature of the production fluid at a location upstream from the downhole equipment of the production well;

generating an alarm signal in the even that said temperature at the upstream location exceeds a threshold temperature characteristic of injection vapor breakthrough; and shutting off supply of electric power to the downhole equipment in response to receiving said alarm signal, wherein the upstream location is sufficiently upstream from the downhole equipment such that the task of shutting off supply of electric power is performed prior to the downhole equipment reaching the threshold temperature characteristic of injection vapor breakthrough; and wherein said temperature is observed by optical time-domain reflectometry of optical pulses that propagate along an optical fiber that extends at least to said location upstream from the downhole equipment.

17. A method according to claim 16, further comprising:

generating an alarm clear signal in the event that said temperature is characteristic that normal production fluid flow has resumed.

18. A method according to claim 17, further comprising:

controlling the supply of electric power to the downhole equipment in accordance with a designated control scheme in response to receiving said alarm clear signal.

19. A method according to claim 16, wherein:

the downhole equipment comprises an electrical submersible pump that is fluidly coupled to a production string that extends to the surface.

20. A method according to claim 16, wherein:

said production fluid comprises recovered heavy oil.

21. A method according to claim 20, wherein:

said recovered heavy oil is extracted from bitumen.

22. A method for use in a heat assisted fluid recovery application that injects hot vaporized fluid in the vicinity of a production well, the production well employing surface equipment that is thermally coupled to the production fluid pumped therefrom, the method comprising:

providing a production fluid path that thermally couples the production fluid to the surface equipment when the production fluid flows in said production fluid path;

providing a bypass path for production fluid around the surface equipment together with a bypass valve for selectively directing production fluid to the bypass path and away from the production fluid path;

deriving an estimate of the temperature of the production fluid at a surface location upstream from the surface equipment of the production well;

generating an alarm signal in the event that said temperature at the upstream surface location exceeds a threshold temperature characteristic of injection vapor breakthrough; and in response to receiving said alarm signal, controlling said bypass valve to direct production fluid to said bypass path and away from said production fluid path to avoid thermal coupling of the injection vapor breakthrough to the surface equipment through said production fluid path.

23. A method according to claim 22, further comprising:

generating an alarm clear signal in the event that said temperature is characteristic that normal production fluid flow has resumed.

24. The method according to claim 23, wherein:

deactivating said bypass valve in response to receiving said alarm clear signal.

25. A method according to claim 22, wherein:

said temperature is derived by optical time-domain reflectometry of optical pulses that propagate along an optical fiber that extends to said surface location upstream from the surface equipment.

26. A method according to claim 22, wherein:

the surface equipment comprises a multiphase flowmeter that analyzes production fluid flowing through a production string that extends down the production well.

27. A method according to claim 22, wherein:

said production fluid comprises recovered heavy oil.

28. A method according to claim 27, wherein:

said recovered heavy oil is extracted from bitumen.

29. A system for heat assisted fluid recovery comprising:

at least one injection well and at least one production well, said at least one injection well injecting hot vaporized fluid in the vicinity of the at least one production well, the at least one production well employing electrically powered downhole equipment to pump production fluid therefrom:

a temperature sensor to observe temperature of the production fluid at a location upstream from the downhole equipment of the production well;

an alarm system to generate an alarm signal in the event that said temperature at the upstream location exceeds a threshold temperature characteristic of injection vapor breakthrough; and in response to receiving said alarm signal, a controller to shut off supply of electric power to the downhole equipment prior to the downhole equipment reaching the threshold temperature characteristic of injection vapor breakthrough; and wherein the temperature sensor comprises an optical fiber that extends down the production well at least to said location upstream from the downhole equipment.

30. A system according to claim 29, wherein the alarm system generates an alarm clear signal in the event that said temperature is characteristic that normal production fluid flow has resumed.

31. A system according to claim 30, wherein:

said controller controls supply of electric power to the downhole equipment in accordance with a designated control scheme in response to receiving said alarm clear signal.

32. A system according to claim 29, wherein:

said temperature sensor observes a temperature measurement at said location upstream from the downhole equipment by optical time-domain reflectometry of optical pulses that propagate along said optical fiber.

33. A system according to claim 29, wherein:

the downhole equipment comprises an electrical submersible pump that is fluidly coupled to a production string that extends to the surface.

34. A system according to claim 29, wherein:

said production fluid comprises recovered heavy oil.

35. A system according to claim 34, wherein:

said recovered heavy oil is extracted from bitumen.

36. A system for heat assisted fluid recovery comprising:

at least one injection well and at least one production well, said at least one injection well injecting hot vaporized fluid in the vicinity of the at least one production well, the at least one production well employing surface equipment that is thermally coupled to the production fluid pumped therefrom;

a production fluid path through which the production fluid is thermally coupled to the surface equipment when the production fluid flows through said production fluid path;

a bypass path for the production fluid around the surface equipment;

a bypass valve to selectively direct production fluid to said bypass path and away from said production fluid path;

a temperature sensor to observe temperature of the production fluid at a surface location upstream from the surface equipment of the production well;

an alarm system to generate an alarm signal in the event that said temperature at the upstream location exceeds a threshold temperature characteristic of injection vapor breakthrough; and in response to receiving said alarm signal, a controller to control said bypass valve means to direct production fluid to said bypass path and away from said production fluid path to avoid thermal coupling of the production fluid to the surface equipment through said production fluid path.

37. A system according to claim 36, wherein the alarm system generates an alarm clear signal in the event that said temperature is characteristic that normal production flow has resumed.

38. A system according to claim 37, wherein:

said controller deactivates said bypass valve means in response to receiving said alarm clear signal.

39. A system according to claim 36, wherein:

the temperature sensor comprises an optical fiber that extends at least to said surface location upstream from the surface equipment.

40. A system according to claim 39, wherein:

said temperature sensor observes a temperature measurement at said surface location upstream from the surface equipment by optical time-domain relectometry of optical pulses that propagate along said optical fiber.

41. A system according to claim 36, wherein:

the surface equipment comprises a multiphase flowmeter that analyzes production fluid flowing through a production string that extends down the production well.

42. A system according to claim 36, wherein:

said production fluid comprises recovered heavy oil.

43. A system according to claim 42, wherein:

said recovered heavy oil is extracted from bitumen.

44. An apparatus for use in a heat assisted fluid recovery application that injects hot vaporized fluid in the vicinity of a production well, the production well employing electrically powered downhole equipment to pump production fluid therefrom as well as surface equipment that is thermally coupled to the production fluid pumped therefrom, the apparatus comprising:

a production fluid pat through which production fluid is thermally coupled to the surface equipment when the production fluid flows through said production fluid path;

a bypass path for the production fluid around the surface equipment;

a bypass valve to selectively direct production fluid to said bypass path and away from said production fluid path;

a temperature sensor to observe a first temperature of the production fluid at a first location which is upstream from the surface equipment of the production well and a second temperature of the production fluid at a second location which is upstream from the downhole equipment;

an alarm system to generate a first alarm signal in the event that said first temperature exceeds a threshold temperature characteristic of injection vapor breakthrough, and a second alarm signal in the event that said second temperature exceeds a threshold temperature characteristic of injection vapor breakthrough; and a controller to control said bypass valve to direct production fluid to said bypass path and away from said production fluid path in response to receiving said first alarm signal, and to shut off supply of electric power to the downhole equipment prior to the downhole equipment reaching the threshold temperature characteristic of injection vapor breakthrough in response to receiving said second alarm signal.

45. An apparatus according to claim 44, wherein:

said temperature sensor observes a temperature measurement at said second location upstream from the downhole equipment by optical time-domain reflectometry of optical pulses that propagate along an optical fiber that at least extends between said first and second locations.

46. An apparatus for use in a heat assisted fluid recovery application that injects hot vaporized fluid in the vicinity of a production well, the production well employing electrically powered downhole equipment to pump production fluid therefrom, the apparatus comprising:

pressure sensor and monitoring means for characterizing pressure of the production fluid at a location upstream from the downhole equipment of the production well;

alarm generation means for generating an alarm signal in the event that said pressure at the upstream location exceeds a threshold pressure characteristic of injection vapor breakthrough; and in response to receiving said alarm signal, control means, operably coupled to said alarm generation means and said downhole equipment, for shutting off supply of electric power to the downhole equipment prior to the downhole equipment reaching the threshold temperature characteristic of injection vapor breakthrough.

47. An apparatus for use in a heat assisted fluid recovery application that injects hot vaporized fluid in the vicinity of a production well, the production well employing surface equipment that is thermally coupled to the production fluid pumped therefrom, the apparatus comprising:

a production fluid path through which the production fluid is thermally coupled to the surface equipment;

a bypass path for the production fluid around the surface equipment;

bypass valve means for selectively directing production fluid to said bypass path and away from said production fluid path;

pressure sensor and monitoring means for characterizing pressure of the production fluid at a surface location upstream from the surface equipment of the production well;

alarm generation means for generating an alarm signal in the event that said pressure at the upstream surface location exceeds a threshold pressure characteristic of injection vapor breakthrough; and in response to receiving said alarm signal, control means, operably coupled to said alarm generation means and said bypass valve means, for controlling said bypass valve means to direct production fluid to said bypass path to avoid thermal coupling of the production fluid to the surface equipment through said production fluid path.

48. A method for use in a heat assisted fluid recovery application that injects hot vaporized fluid in the vicinity of a production well, the production well employing electrically powered downhole equipment to pump production fluid therefrom, the method comprising:

deriving an estimate of the pressure of the production fluid at a location upstream from the downhole equipment of the production well;

generating an alarm signal in the event that said pressure at the upstream location exceeds a threshold pressure characteristic of injection vapor breakthrough; and shutting off supply of electric power to the downhole equipment in response to receiving said alarm signal, wherein the upstream location is sufficiently upstream of the downhole equipment such that the task of shutting off supply of electric power is performed prior to the downhole equipment reaching the threshold temperature characteristic of injection vapor breakthrough; and wherein the pressure of the production fluid at a location upstream from the downhole equipment of the production well is estimated via a an optical fiber pressure sensor that extends down the production well at least to said location upstream from the downhole equipment.

49. A method for use in a heat assisted fluid recovery application that injects hot vaporized fluid in the vicinity of a production well, the production well employing surface equipment that is thermally coupled to the production fluid pumped therefrom, the method comprising:

providing a production fluid path through which the production fluid is thermally coupled to the surface equipment;

providing a bypass path for production fluid around the surface equipment together with a bypass valve for selectively directing production fluid to the bypass path and away from the production fluid path;

deriving an estimate of the pressure of the production fluid at a surface location upstream from the surface equipment of the production well;

generating an alarm signal in the event that said pressure at the upstream surface location exceeds a threshold pressure characteristic of injection vapor breakthrough; and controlling said bypass valve to direct production fluid to said bypass path and away from said production fluid path in response to receiving said alarm signal to avoid thermal coupling of the injection vapor breakthrough to the surface equipment through the production fluid path.

* * * * *